US009175937B1

(12) United States Patent
Reeves et al.

(10) Patent No.: US 9,175,937 B1
(45) Date of Patent: Nov. 3, 2015

(54) GASLESS IGNITION SYSTEM AND METHOD FOR MAKING SAME

(75) Inventors: Robert V. Reeves, Albuquerque, NM (US); Steven F. Son, West Lafayette, IN (US); Lori J. Groven, Clarks Hill, IN (US); Alexander S. Mukasyan, Granger, IN (US)

(73) Assignee: Purdue Research Foundation, West Lafayette, IN (US)

( * ) Notice: Subject to any disclaimer, the term of this patent is extended or adjusted under 35 U.S.C. 154(b) by 531 days.

(21) Appl. No.: 13/442,853

(22) Filed: Apr. 9, 2012

Related U.S. Application Data

(60) Provisional application No. 61/473,552, filed on Apr. 8, 2011.

(51) Int. Cl.
*F42B 3/16* (2006.01)
*F42B 3/11* (2006.01)

(52) U.S. Cl.
CPC .... *F42B 3/16* (2013.01); *F42B 3/11* (2013.01)

(58) Field of Classification Search
USPC ..... 102/202.5–202.14, 275.9, 205, 275.11, 102/283, 285, 286, 288, 292
See application file for complete search history.

(56) References Cited

U.S. PATENT DOCUMENTS

| | | | | |
|---|---|---|---|---|
| 2,105,674 | A | 1/1938 | Sosson | |
| 2,127,603 | A | 8/1938 | Jones | |
| 3,140,208 | A | 7/1964 | Adelman | |
| 3,150,020 | A | 9/1964 | Kilmer | |
| 3,727,552 | A * | 4/1973 | Zakheim | 102/275.3 |
| 5,003,879 | A * | 4/1991 | Jones | 102/204 |
| 5,212,343 | A * | 5/1993 | Brupbacher et al. | 102/323 |
| 5,466,537 | A * | 11/1995 | Diede et al. | 428/548 |
| 6,298,784 | B1 * | 10/2001 | Knowlton et al. | 102/275.3 |
| 6,354,222 | B1 * | 3/2002 | Becker et al. | 102/513 |
| 6,539,869 | B2 * | 4/2003 | Knowlton et al. | 102/275.3 |
| 7,501,551 | B2 * | 3/2009 | Eidelman et al. | 588/403 |
| 7,930,976 | B2 * | 4/2011 | Kellett et al. | 102/275.9 |
| 8,505,427 | B2 * | 8/2013 | Wilson et al. | 89/1.13 |
| 2002/0035945 | A1 * | 3/2002 | Knowlton et al. | 102/275.3 |
| 2008/0173206 | A1 * | 7/2008 | Langan et al. | 102/476 |
| 2009/0031911 | A1 * | 2/2009 | Kellett et al. | 102/276 |

OTHER PUBLICATIONS

White, J. et al., "Thermal Explosion in Al—Ni System: Influence of Mechanical Activation," J. Phys. Chem. A, vol. 113, No. 48, Dec. 3, 2009, pp. 13541-13547.

* cited by examiner

*Primary Examiner* — Benjamin P Lee
(74) *Attorney, Agent, or Firm* — Pauley Erickson & Kottis

(57) ABSTRACT

A fuze includes a housing having a first end and an opposing second end and defining an elongate channel extending between the first and second ends; and a mechanically activated reactive material comprising at least first and second elements disposed within the channel.

25 Claims, 3 Drawing Sheets

GASLESS IGNITION SYSTEM AND METHOD FOR MAKING SAME

CROSS-REFERENCE TO RELATED APPLICATION

This application claims the benefit of Provisional Patent Application No. 61/473,552, filed Apr. 8, 2011, which application is hereby incorporated by reference along with all references cited therein.

GOVERNMENT RIGHTS

This invention was made with government support under Contract/Grant No. N00014-07-1-0969 awarded by the Office of Naval Research, and under Contract/Grant No. HDTRA1-08-1-0006 awarded by the Defense Threat Reduction Agency. The government has certain rights in the invention.

SUMMARY OF THE INVENTION

Generally speaking, a gasless ignition system (or fuze or delay element) includes a housing having a first end and an opposing second end and defining an elongate channel extending between the first and second ends; and a mechanically activated reactive material comprising at least first and second elements disposed within the channel.

It is an object of the present invention to provide an improved gasless ignition system.

Other objects and advantages of the present invention will be more apparent upon reading the following detailed description in conjunction with the accompanying drawings.

DESCRIPTION OF THE PREFERRED EMBODIMENT

For the purposes of promoting an understanding of the principles of the invention, reference will now be made to the embodiments illustrated herein and specific language will be used to describe the same. It will nevertheless be understood that no limitation of the scope of the invention is thereby intended. Any alterations and further modifications in the described processes, systems or devices, and any further applications of the principles of the invention as described herein, are contemplated as would normally occur to one skilled in the art to which the invention relates.

Generally speaking, a tunable gasless fuze is provided that has no gas byproduct during its combustion and can be tuned to ignite upon introduction to a substantially precise level of input energy and can be tuned to burn at a selected rate.

Figure 1:
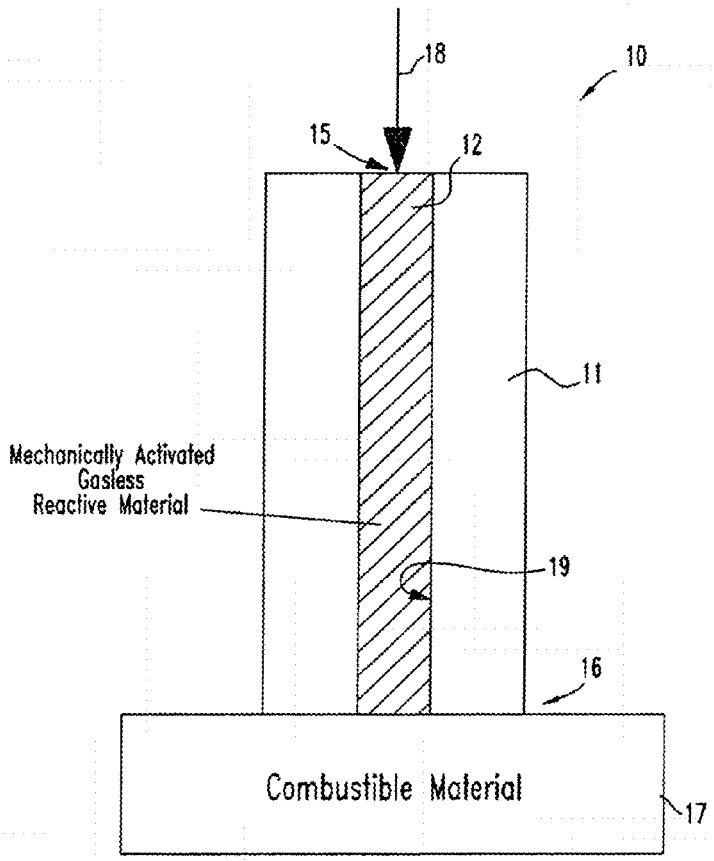
FIG. 1 is a side, cross-sectional view of a gasless ignition system 10 with tunable delay in accordance with one embodiment of the present invention.

Referring to FIG. 1, there is shown a gasless ignition system (used interchangeably herein with "fuze" or "delay element") 10 with tunable delay in accordance with one embodiment of the present invention. Fuze 10 generally comprises a housing 11 and a reactive material 12 that burns without a gas byproduct and acts, upon ignition at a first end 15 to ignite a combustible material 17 located at its opposite, second end 16. In one embodiment, the reactive material 12 comprises aluminum and nickel that has been mechanically activated.

Housing 11 is any appropriate material that will hold the reactive material 12 in its physical condition throughout it combustion, such as metal, paper, ceramic, etc.

Mechanical activation is achieved by subjecting the reactive material to high energy ball milling, as discussed in J. D. E. White et al., "Thermal Explosion in Al—Ni System: Influence of Mechanical Activation," *J. Phys. Chem. A*, Vol. 113, No. 48, pp. 13541-13547, which is hereby incorporated by reference in its entirety. The reactive (the reactive material of a fuze) is typically a mixture of metal-metal or metal-non metal powders capable of producing a heterogeneous intermetallic material (NiAl, NiTi, etc.) or a refractory inorganic compound (TiC, $TiB_2$, SiC, etc.) upon reaction. Both stoichiometric and non-stoichiometric mixtures of these powders, as well as mixtures that include other additives, are contemplated to function well as the reactive material. Many of the materials that are appropriate for the mechanical activation described herein also provide a benefit in being of a type that are environmentally benign and less or not hazardous to human or animal health.

Figure 3:
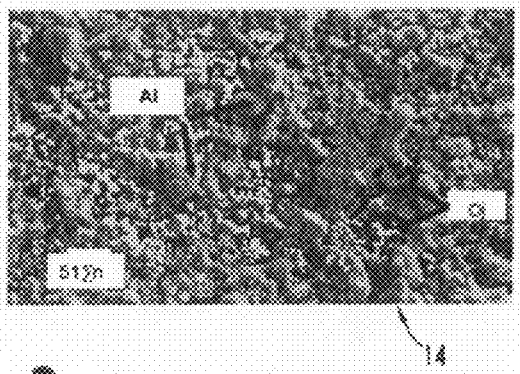
FIG. 3 is an enlarged micrograph of a non-mechanically activated reactive mixture 14 comprising aluminum powder and nickel powder of the ignition system 10 of FIG. 1.
Figure 4:
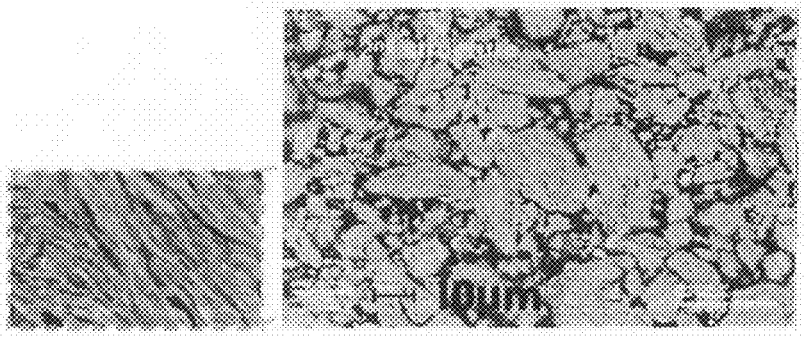
FIG. 4 is an enlarged micrograph of a mechanically activated reactive mixture 14 of aluminum and nickel, with a further enlarged portion of one of the mechanically activated particles.
Figure 5:
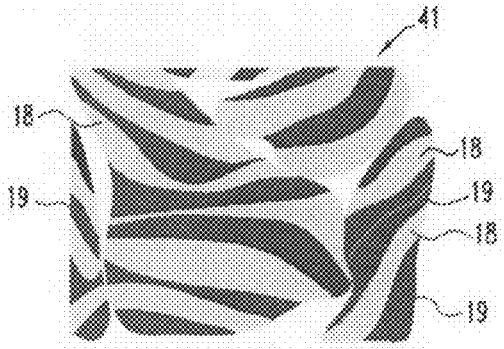
FIG. 5 is a sketch depicting the mechanically activated reactive material 41 of FIG. 4.

In FIG. 3 there is shown one example of a non-mechanically activated reactive material 14 comprising a mixture of 325 mesh aluminum powder and 3-7 μm nickel powder. Subjecting mixture 14 to mechanical activation reconfigures the materials into mechanically activated reactive material (ARM) 41, comprising alternating strata, as shown in FIG. 4 and depicted in FIG. 5, with the aluminum stratum 18 and the nickel stratum 19 having been forced together to form an extraordinarily high degree of interfacial, reactionary surface area. Here, a mechanically activated reactive material means a composition containing at least two elements that, upon heating to an ignition temperature ($T_{IG}$), will burn in the absence of other elements or externally provided heat, and wherein such two or more elements have been mechanically acted upon to deform into configurations wherein the specific area of interfacial contact among such two or more elements is considerably (i.e., more than 10 times) greater than before such mechanical activation.

Alternative embodiments are contemplated wherein the mechanically activated reactive material 14 is deformed to achieve a combined area of interfacial contact among such two or more elements that is less than 10 times that of non-mechanically activated reactive materials (such as powders), but still operates with a higher desired combustion rate and/or a decreased ignition temperature than that of non-mechanically activated reactive materials.

In one embodiment, the ball milling machine comprises a generally circular bowl, into which is deposited the aluminum and nickel powders along with ball bearings or similar agitating members. A lid covers the bowl, and the bowl is mounted in a machine that rotates the bowl about multiple axes to cause the ball bearings to act upon the powders, as described herein. Alternative embodiments are contemplated wherein the mechanical activation is accomplished in other ways that results in essentially the same physical reconfiguration of the reactive materials (e.g., Ni and Al) to substantially increase the interfacial contact among such reactive materials.

The delay of fuze 10 is the time it takes for fuze 10 to burn from its point of ignition 15 essentially to its opposite end 16 adjacent or proximal to the corresponding combustible material 17, whereupon the energy output of fuze 10 ignites combustible material 17. The delay of a fuze, in general, is a function of the material comprising the fuze, the cross-sectional size and shape of the fuze, the length of the fuze and the extent of limitation of heat loss from the fuze during its combustion.

More selective variation of the delay is achieved in fuze 10 by varying the extent of mechanical activation applied to the reactive material. That is, mechanical activation increases the area of contact between the reactive materials (Al and Ni), and by varying the extent of mechanical activation, the amount of such interfacial contact area is varied. The extent of mechanical activation can be varied, inter alia, by varying the milling intensity or the overall milling duration. Increasing the milling intensity and/or milling duration acts to further compress the materials and increase the number of strata, which increases the overall specific contact surface between reactives. Increasing the milling intensity is done by increasing the rotational speeds of the ball milling machine, varying the number and/or size of milling media (e.g., ball bearings), and by other means known in the art of such machine.

As such contact area is increased, the duration of the delay is shortened and the burning rate of the ARM is increased. Alternatively, decreasing the extent of mechanical activation will result in a slower burning rate material and a longer delay fuze. Furthermore, because of the increased interfacial contact areas, ARMs have a higher burning rate than non-mechanically activated materials and can be expected to propagate in a small channel better than non-mechanically activated compositions and can be expected to propagate in smaller channels where a non-mechanically activated reactive material would otherwise not be able to propagate. For example, in the reaction $$Ni+Al \rightarrow NiAl$$

the adiabatic reaction temperature ($T_{ad}$) will be about 1900K; and, for powders, the ignition temperature ($T_{IG}$) is about 930K, while for an ARM the ignition temperature ($T_{IG}$) is between 500-700K, depending on the extent of mechanical activation. However, the rate of combustion for the ARM, owing to the increased interfacial contact area, will be two to three times that of the powder mixture, and likely considerably more. As a particular reactive mixture 12 burns within the fuze housing 11, heat losses through housing 11 can exceed the rate of heat generated by combustion of the reactive material 12. If the channel 19 defined by housing 11 is too small for a given length, the heat generated by the slower burning powder material will not be enough to sustain combustion, and the powder based reaction will quench, while the ARM will continue to burn. Thus, the ARM will effectively burn and ignite the combustible material 17 in a smaller fuze channel 19 where the powder material will not.

Current delay compositions rely heavily on the use of barium chromate and potassium perchlorate, which are both toxic and environmentally hazardous, while Al and Ni compositions are considerably more environmentally friendly and less or non-toxic.

In manufacture, the ARM 12 is packed into channel 19 of housing 11 with the appropriate force to keep ARM 12 in place and to achieve the desired material burn in a fashion similar to non-mechanically activated reactive materials.

The operation of the fuze begins with an input energy source 18 that ignites the mechanically activated material 12 in the delay element 10. The delay element 10 then burns at a rate dependent on its mechanical activation level, providing the desired delay time. After the delay element combustion is complete, the heat release from the mechanically activated material ignites the combustible material (main charge) 17.

Figure 2:
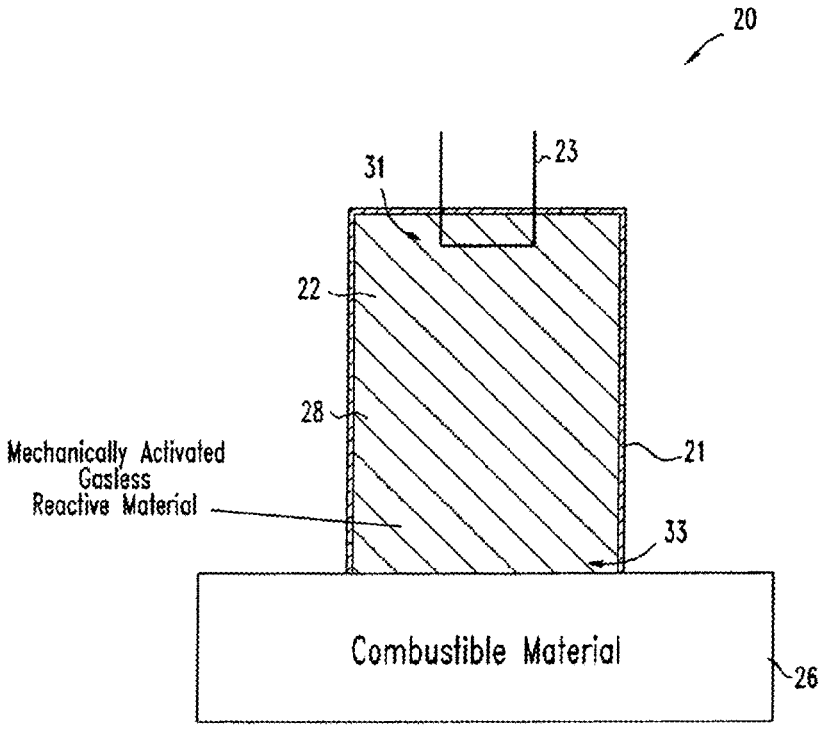
FIG. 2 is a side, cross-sectional view of a gasless ignition system 20 in accordance with another embodiment of the present invention.

In another embodiment shown in FIG. 2, a gasless ignition system 20 provides precise timing control and tunable ignition energy. Gasless ignition system 20 includes a housing 21, a material charge 22, and an initiator element 23. The housing 21 is here a metal cup, but can be any appropriate structure configured to hold reactive material 22 in the desired shape and position adjacent a corresponding combustible material 26. The initiator element is an Explosive Bridge Wire (EBW), semiconductor bridge (SCB) or hot wire, or any suitable initiating device for delivering a desired energy input to material charge 22.

Like reactive material 14, material charge 22 comprises a mass of mechanically activated gasless heterogeneous reactive material 28, that is, a reactive material such as a metal-metal (e.g., Ni—Al) combination that has been subjected to mechanical activation (high energy ball milling or a similar process), as discussed in J. D. E. White et al., id. The mechanical activation process (high energy ball milling of the reactive material) allows the sensitivity of the gasless reactive mixture to its initiator energy input to be controlled. That is, the level of energy required to initiate exothermic reaction of the reactive material 28 can be selectively determined by varying the extent of mechanical activation. The extent of mechanical activation can be varied, inter alia, by varying the milling intensity or the overall milling duration. Igniter 20 can also include a small mass of oxidizable metal powder (not shown), like Zr or Ti positioned in one or more isolated areas and/or intermixed with the mechanically activated material 28. The material charge 22 of gasless ignition system 20 could also contain another highly exothermic gasless heterogeneous mixture (not shown) that is not mechanically activated, but is ignitable with the mechanically activated mixture 28.

The gasless ignition system 20 is initiated through an electric pulse sent from an external power supply to initiator element 23, which then provides energy to the mechanically activated reactive material (ARM) 28. When the energy thus imparted to ARM 28 reaches the desired (and specifically determined) threshold level, the ARM 28 ignites and burns from its point of ignition 31 and outwardly therefrom until it reaches its opposite end 33 proximal the corresponding combustion material 26, against which it has been positioned. The combustion of ARM 28 releases heat completely through gasless reaction processes, which avoids the otherwise attendant volumetric gaseous expansion and explosion of the igniter 20. The heat released by igniter 20 at its opposite end 33 ignites the combustible material 26, as desired. The heat release also ignites the optional metal powder, which reacts exothermically with any pore gases, acting as a gas scavenger. The mechanically activated material 28 provides high heat release and can be tuned to ignite at different energy inputs, allowing for selection of appropriate EBW, SCB, or hot wire to provide the necessary resistance to inadvertent discharge.

This invention provides relatively precise timing control through use of the EBW or SCB, and it is a truly gasless system. Other ignition systems using a hot wire to provide the initial energy input do not inherently provide such precision in the ignition timing control as the required heating time in such systems will depend on the environmental heat loss conditions experienced by the igniter system. Use of mechanically activated reactive material will allow the use of a hot wire as a precise timing initiator, as the mechanically activated material can be made sufficiently sensitive to ignite at a desired controlled thermal inputs. For example, where it may be desired that ignition be achieved at with a specific low thermal input threshold, the mechanically activated reactive material can be processed to ignite at that threshold.

The invention also provides a completely gasless heat source, in contrast to other EBW or SCB initiated ignition systems. Such other systems utilizing EBWs or SCBs use a sensitive primary material, like lead azide, to initiate the igniter. Such materials upon ignition produce significant amounts of gas, and such igniters cannot, therefore, be considered gasless.

The invention has application for use with initiation of rocket motors, explosives, pyrotechnics (including fireworks), and expendable heat sources, but is not limited to these applications. Any application requiring an application of heat without a gas byproduct that could overpressurize the corresponding container, object or system would benefit from this invention.

Alternative embodiments are contemplated wherein ignition system 10 comprises a reactive material that does not result in gasless ignition, but that is tuned as described for ignition system 10 by being mechanically activated. While not gasless and thus not appropriate for uses where "gasless" ignition is required or desired, such non-gasless reactive material may nevertheless benefit from being tuned to have a more precise ignition temperature, a lower ignition temperature, a higher combustion rate, and/or the ability to propagate better in a smaller channel.

Alternative embodiments are contemplated wherein the mechanical activation is not "high-energy", but is of any energy level, extent, duration or other characteristic that achieves the desired level of mechanical activation to deform and reconfigure the constituent reactive materials into strata or shapes that significantly increase the total contact surface area among the reactive materials to achieve a more precise ignition temperature, a lower ignition temperature, a higher combustion rate, and/or the ability to propagate better in a smaller channel.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for making a gasless ignition system for igniting a material charge, comprising the steps of:

providing a housing having a first end and an opposing second end and defining an elongate channel extending between the first and second ends;

mechanically activating a reactive material comprising at least first and second elements;

packing said housing with the mechanically activated reactive material;

positioning an initiator element at the first end of the housing and in contact with the mechanically activated reactive material; and positioning the second end of the housing adjacent a combustible material, wherein, upon actuation of the initiator element, the mechanically activated reactive material burns from its point of ignition at the first end of the housing to the opposite second end of the housing to ignite the combustible material, wherein the gasless ignition system provides a delay measured as the time it takes for the mechanically activated reactive material to burn from its point of ignition at the first end of the housing to the opposite second end of the housing and the mechanically activated reactive material in said housing has an ignition input energy level, and wherein at least one of the duration of the delay and the ignition input energy level is selectively determined by varying at least one of the intensity and duration of the mechanical activation.

2. The method for making a gasless ignition system of claim 1 wherein said mechanically activating step includes the reactive material having at least first and second elements that, upon heating to an ignition temperature (TIG) will burn in the absence of other elements or externally provided heat.

3. The method for making a gasless ignition system of claim 1 wherein said mechanically activating step includes the reactive material being capable upon combustion of producing a heterogeneous intermetallic material.

4. The method for making a gasless ignition system of claim 3 wherein said mechanically activating step includes the heterogeneous intermetallic material being one of NiAl and NiTi.

5. The method for making a gasless ignition system of claim 1 wherein said mechanically activating step includes the reactive material being capable upon combustion of producing a refractory inorganic compound.

6. The method for making a gasless ignition system of claim 5 wherein said mechanically activating step includes the refractory inorganic compound being one of TiC, $TiB_2$, SiC.

7. The method for making a gasless ignition system of claim 1 wherein said positioning step includes the initiator element being one of an explosive bridge wire, a semiconductor bridge and a hot wire.

8. The method for making a gasless ignition system of claim 1 wherein said mechanically activating step includes subjecting a mixture of at least two elements to ball milling.

9. The method for making a gasless ignition system of claim 8 wherein said mechanically activating step includes the at least two elements being one of metal-metal and metal-non metal, the at least two elements defining a specific area of interfacial contact therebetween.

10. The method for making a gasless ignition system of claim 8 wherein said mechanically activating step includes the materials being powders.

11. The method of making a gasless ignition system of claim 9 wherein said mechanically activating step includes subjecting the mixture to ball milling until the specific area of interfacial contact between the at least two elements is at least about 10 times greater than before such ball milling.

12. The method for making a gasless ignition system of claim 9 wherein said mechanically activating step includes the mechanically activated reactive material in said housing having an ignition input energy level and the method for making a gasless ignition system further including selectively determining the ignition input energy level by varying the duration of mechanical activation.

13. The method for making a gasless ignition system of claim 9 wherein said mechanically activating step includes the mechanically activated reactive material in said housing having an ignition input energy level and the method for making a gasless ignition system further including selectively determining the ignition input energy level by varying the intensity of the ball milling.

14. The method for making a gasless ignition system of claim 9 wherein:

said mechanically activating step includes the mechanically activated reactive material in said housing having a delay measured as the time it takes for the mechanically activated reactive material to burn from its point of ignition at the first end of the housing to the opposite second end of the housing and the method for making a gasless ignition system further including selectively determining the delay by varying the duration of mechanical activation.

15. The method for making a gasless ignition system of claim 9 wherein;

said mechanically activating step includes the mechanically activated reactive material in said housing having a delay measured as the time it takes for the mechanically activated reactive material to burn from its point of ignition at the first end of the housing to the opposite second end of the housing and the method for making a gasless ignition systems further including selectively determining the delay by varying the intensity of the ball milling.

16. The method for making a gasless ignition system of claim 9 wherein said packing step includes packing said housing with the mechanically activated reactive material and a small mass of oxidizable metal powder.

17. The method for making a gasless ignition system of claim 9 wherein said packing step includes packing said housing with the mechanically activated reactive material and a non-mechanically activated highly exothermic gasless heterogeneous mixture.

18. A method for making a tunable gasless ignition system, the method comprising:

mechanically activating a reactive material comprising at least two elements that, in the absence of other elements or externally provided heat, will burn upon being heated to an ignition temperature; and placing the mechanically activated reactive material in a housing in reaction initiating communication with an initiator element, wherein the gasless ignition system provides a delay measured as the time it takes for the mechanically activated reactive material to burn from its point of ignition to a material to be combusted and the mechanically activated reactive material has an ignition input energy level, wherein at least one of the duration of the delay and the ignition input energy level is selectively determined by varying at least one of the intensity and duration of the mechanical activation, and wherein the gasless ignition system is tuned to at least one of:

to ignite upon introduction of a substantially precise level of input energy and to burn at a selected rate.

19. The method of claim 18 wherein:

the mechanically activated reactive material has a burn rate that is dependent on a level of mechanical activation of the reactive material.

20. The method of claim 19 wherein the mechanical activation comprises milling and the mechanically activated reactive material has a level of mechanical activation that is varied by varying at least one of milling intensity and milling duration.

21. The method of claim 20 wherein the milling intensity in a milling machine is varied by varying at least one milling parameter of speed, number or size of milling media in the milling machine.

22. The method of claim 18 wherein the mechanically activated reactive material has a higher burn rate than a corresponding non-mechanically activated composition.

23. A method for making a gasless ignition system for igniting a material charge, the method comprising:

making a fuze comprising:

providing a housing having a first end and an opposing second end and defining an elongate channel extending between the first and second ends;

mechanically activating a reactive material comprising at least first and second elements, said mechanical activating comprising milling a mixture of the first and second elements; and placing the mechanically activated reactive material in the housing in reaction initiating communication with an initiator element disposed at the housing first end; and positioning the housing second end adjacent a combustible material, wherein, upon actuation of the initiator element, the mechanically activated reactive material burns from its point of ignition at the housing first end to the opposite second end of the housing to ignite the combustible material, wherein the gasless ignition system provides a delay measured as the time it takes for the mechanically activated reactive material of the fuze to burn from its point of ignition at the first end of the housing to the opposite second end of the housing and the mechanically activated reactive material in said housing has an ignition input energy level, and wherein at least one of the duration of the delay and the ignition input energy level is selectively determined by varying at least one of the intensity and duration of the mechanical activation.

24. The method of claim 23 wherein said mechanically activating step comprises milling and the mechanically activated reactive material has a level of mechanical activation that is varied by varying at least one of milling intensity and milling duration.

25. The method of claim 23 wherein said mechanically activating step includes the reactive material being capable upon combustion of producing a heterogeneous intermetallic material comprising nickel and at least one of aluminum and titanium.

* * * * *